US005133536A

United States Patent [19]

Goodman

[11] Patent Number: 5,133,536

[45] Date of Patent: Jul. 28, 1992

[54] HANDS-FREE HYDRAULIC VISE

[76] Inventor: Robert J. Goodman, 17 Redfox Dr., Albany, N.Y. 12205

[21] Appl. No.: 650,423

[22] Filed: Feb. 4, 1991

[51] Int. Cl.[5] ..... B25B 1/24

[52] U.S. Cl. ..... 269/25; 269/283

[58] Field of Search ..... 269/25, 27, 32, 35, 269/283

[56] References Cited

U.S. PATENT DOCUMENTS

| | | | |
|---|---|---|---|
| 530,733 | 12/1894 | Tower | 269/283 |
| 2,656,820 | 10/1953 | Becker | 269/25 |
| 4,519,592 | 5/1985 | Russell | 269/25 |
| 4,605,208 | 8/1986 | Durham | 269/32 |
| 4,706,949 | 11/1987 | Dossey et al. | 269/283 |
| 4,844,431 | 7/1989 | Camp et al. | 269/25 |

*Primary Examiner*—Robert C. Watson

*Attorney, Agent, or Firm*—Terry M. Gernstein

[57] ABSTRACT

A hands-free vise includes a slide element that is slidably mounted on a body and a hydraulic unit that moves the slide element with respect to the body. The hydraulic unit includes a piston connected to the body and a cylinder connected to the slide element. Hydraulic fluid is moved into and out of a chamber which also contains a piston head to move the housing with respect to the piston. Hydraulic fluid is moved into and out of the chamber by a foot-controlled pump in a pump and reservoir unit.

10 Claims, 9 Drawing Sheets

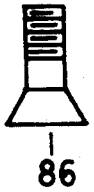
FIG. 7
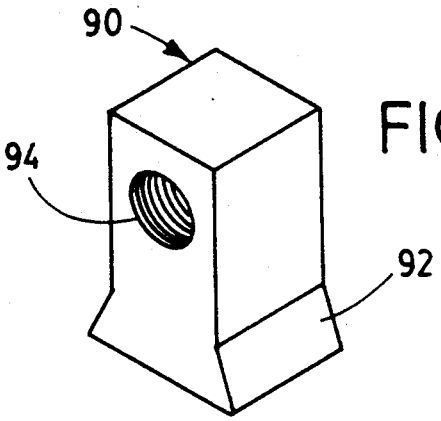
FIG. 8
FIG. 10
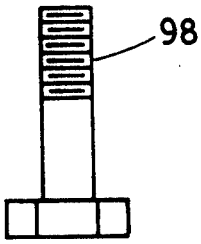
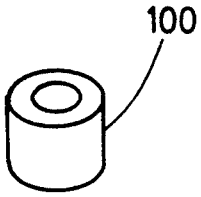
FIG. 9
FIG. 11
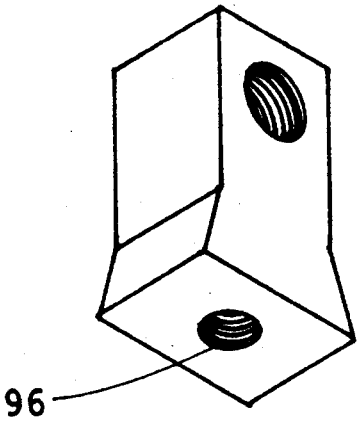

HANDS-FREE HYDRAULIC VISE

TECHNICAL FIELD OF THE INVENTION

The present invention relates to the general art of tools, and to the particular field of vises.

BACKGROUND OF THE INVENTION

A vise is required in many work situations. The user often must balance the workpiece in the vise while working. This often requires a level of dexterity that is quite high. In fact, many situations are so difficult as to detract from the actual work that is being performed.

Accordingly, there is a need for a vise that can be operated in a hands-free manner whereby a user is able to concentrate totally on the work being performed rather than being distracted by a need to operate a vise.

Still further, many work situations require a high degree of holding power for the vise. In some cases, this holding power is higher than can be achieved using a hand-operated vise.

While the art does contain several hydraulic vises that can achieve a high degree of holding power, none of these devices is entirely efficient in operation.

Therefore, there is also a need for a hands-free vise that is efficient in operation and can exert a great deal of holding power.

OBJECTS OF THE INVENTION

It is a main object of the present invention is to provide a hands-free vise.

It is another object of the present invention to provide a hands free vise that can be operated to exert a great deal of holding power.

It is another object of the present invention to provide a hands free vise that utilizes hydraulic power to exert a great deal of holding power.

It is another object of the present invention to provide a hands free vise that efficiently utilizes hydraulic power to exert a great deal of holding power.

SUMMARY OF THE INVENTION

These, and other, objects are achieved by a hydraulically operated vise that includes a hydraulic piston cylinder connected to a slide element with a hydraulic piston located within that cylinder and connected to a stationary base element. Operation of the hydraulic system moves the housing with respect to the piston and thus moves the slide element with respect to the stationary base. Various clamping elements can be mounted on the slide element and on the base element and are movable toward and away from each other as the slide element moves.

The hydraulic system is operated using a foot pedal and thus the overall vise is a hands-free mechanism. Fluid moves to and through a chamber to move the housing with respect to the piston, and pressure gauges are included so the most efficient operating conditions can be set.

BRIEF DESCRIPTION OF THE DRAWING FIGURES

FIG. 7 is an elevational view of a fastener element used to couple a mounting element to the body element.

FIG. 8 is a top and end perspective view of a mounting element that is connected to the body element shown in FIG. 5.

FIG. 9 is a bottom and end perspective view of a mounting element that is connected to the body element shown in FIG. 5.

FIG. 10 is an elevational view of a fastening element used to couple the body element shown in FIG. 5 to the base element shown in FIG. 4.

FIG. 11 is a top and side perspective view of a bushing element that cooperates with the fastener element shown in FIG. 10.

DETAILED DESCRIPTION OF THE PREFERRED EMBODIMENT OF THE INVENTION

Figure 1:
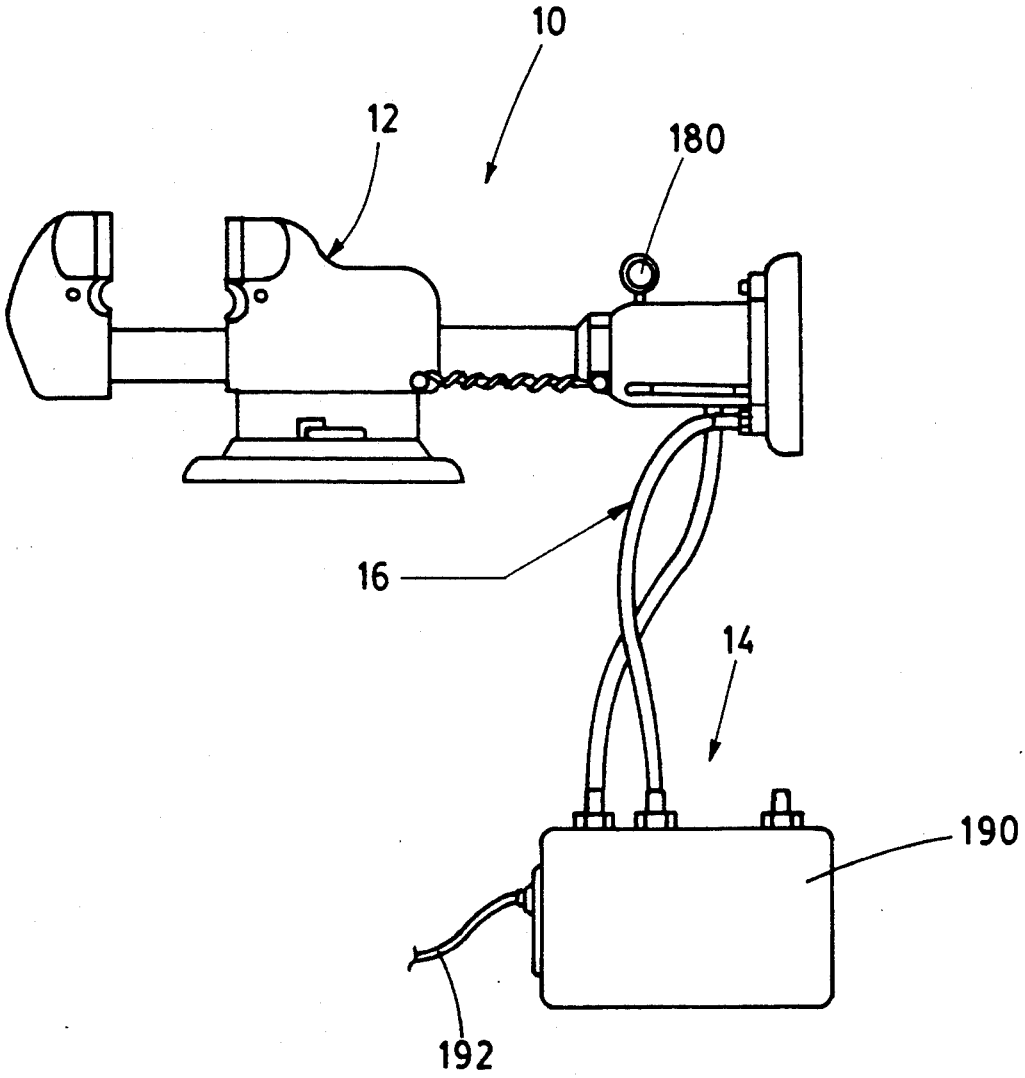
FIG. 1 illustrates an elevational view of the overall vise mechanism of the present invention.

Shown in FIG. 1 is a hydraulic vise mechanism 10 that embodies the present invention. The vise mechanism 10 permits a user to operate it in a readily controlled hands-free manner if suitable. Generally, the mechanism 10 includes a vise unit 12 that is mounted on a workbench or other such support, a hydraulic unit 14 that is mounted on a floor near the vise unit 12 and a hydraulic connection system 16 connecting the vise unit 12 to the hydraulic unit 14. The hydraulic unit 14 is operated by a user's foot so his hands are free to carry out the tasks associated with the vise mechanism 10.

Figure 2:
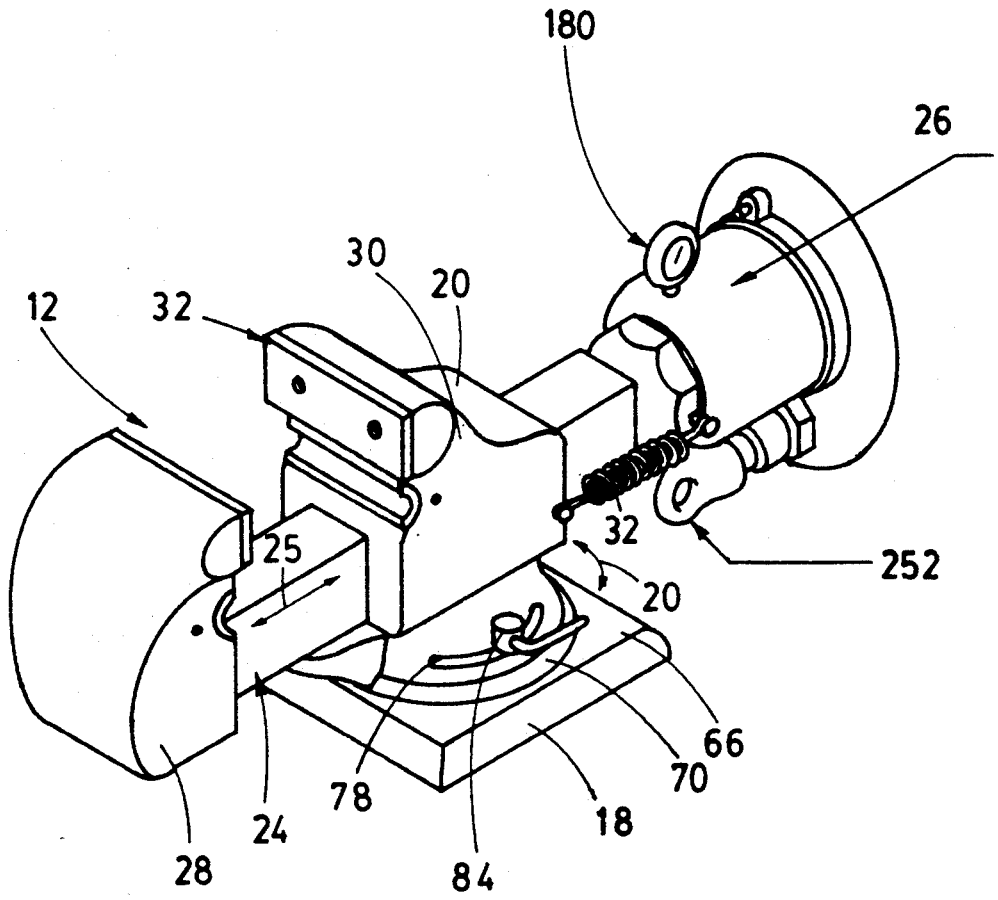
FIG. 2 is a perspective view of the overall vise mechanism.
Figure 3:
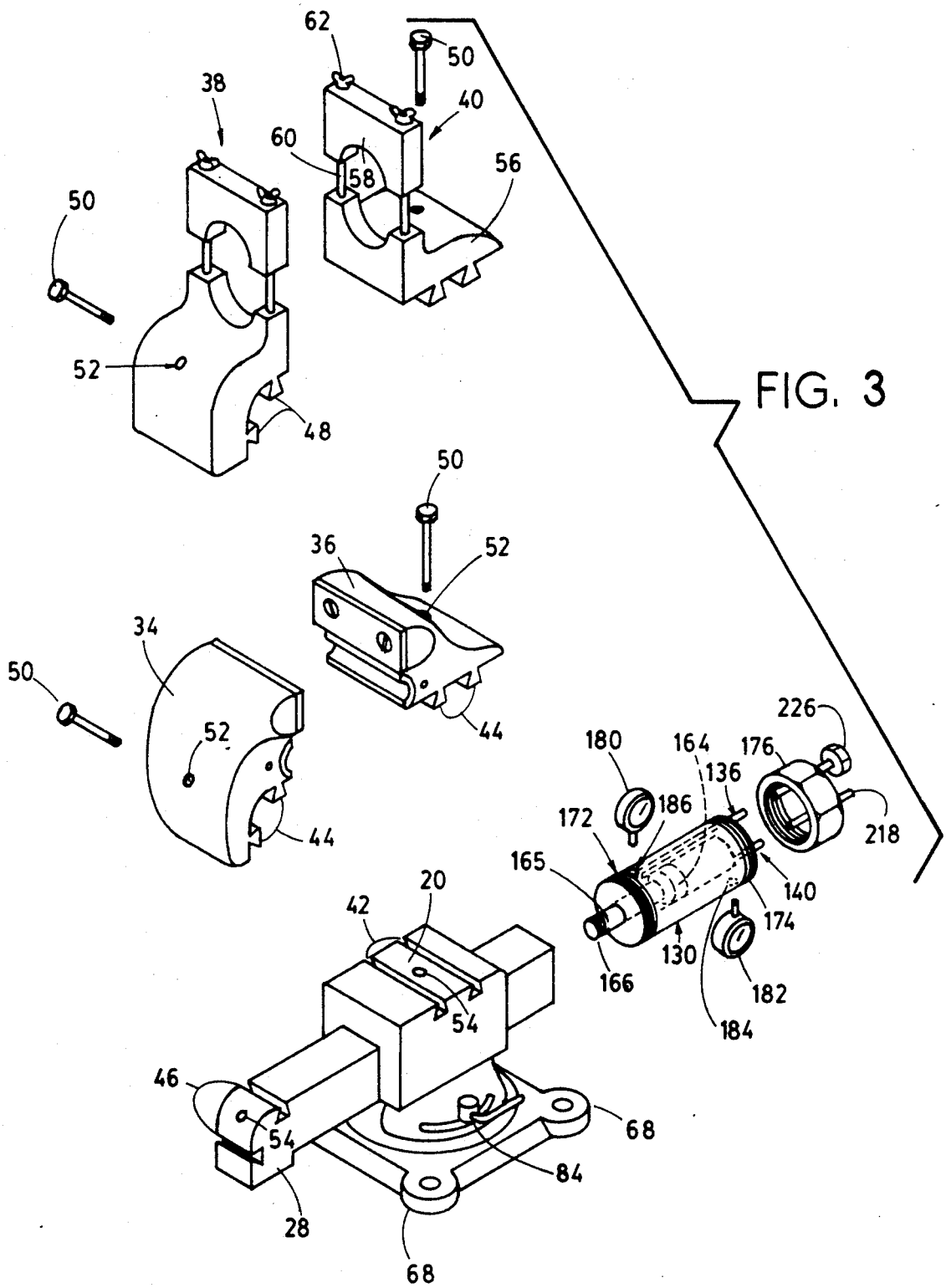
FIG. 3 is an exploded perspective view of the overall vise mechanism.

More specifically, referring to FIGS. 2 and 3, it is seen that the vise unit 12 includes a base unit 18 on which is mounted a vise body 20. The body 20 is adapted to swivel with respect to the base unit as indicated in FIG. 2 by the double-headed arrow 22. A slide element 24 is slidably mounted to the body 20 to move within that body in the directions indicated by the double-headed arrow 25. The slide element is connected at one end thereof to a hydraulic piston unit 26 and has a first clamp supporting element 28 on another end thereof. A second clamp supporting element 30 is mounted on the body 20, with the first clamp supporting element moving toward and away from the second clamp supporting element during operation of the vise. The slide element 24 is moved by a combination of hydraulic power via the unit 26 and spring power from a spring 32 connected at one end thereof to the hydraulic unit 26 and at the other end thereof to the base 20.

Referring next to FIG. 3 in particular, the vise unit 12 is seen to be useable with several different forms of clamping elements. For example, the clamping elements can be in the form of typical vise jaws, such as jaws 34 and 36 or clam shell-type clamping plates 38 and 40. The clamping elements are mounted to the vise clamp supporting elements 28 and 30 by means of dovetail type connections that include parallel and spaced apart dovetail grooves 42 on the base 20 matingly receiving parallel and spaced apart dovetail elements 44 on the jaw 36 or similar dovetail elements 46 on clamping plate 40; and by means of dovetail grooves 46 defined in element 28 slidably accommodating elements 48 of the element 38. Fastening elements, such as threaded bolts 50, fit through suitable bores, such as bores 52, and are threadably received in threaded bores, such as bores 54, to secure the clamping elements to the clamping element supporting elements.

As can be seen in FIG. 3, the clam shell-type clamp elements include bottom portions, such as portions 56 and top portions, such as portions 58 that are connected together by threaded fasteners, such as threaded bolts 60 having gripping elements, such as wing nuts 62, thereon. As will occur to those skilled in the art based on this disclosure, the elements 36 could serve as the bottom portions 56 if suitably modified to receive the dovetail elements 48 and the fasteners 60.

Figure 4:
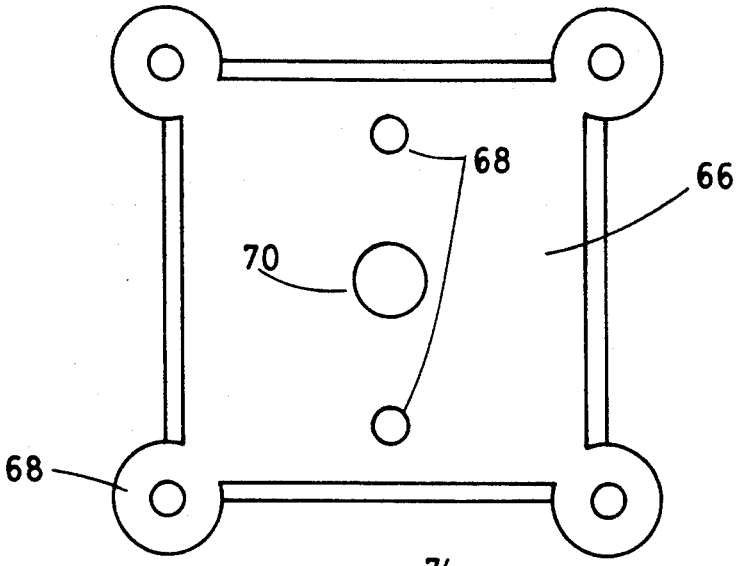
FIG. 4 is a top plan view of a base element of the vise mechanism.

Referring to FIGS. 3 and 4, it is seen that the base unit includes a base plate 66 that is mounted on a work surface by legs 68. The base plate 66 includes two fastener receiving bores 68 near the ends thereof and one fastener receiving bore 70 near the center thereof. The purpose of such fastener receiving bores will be understood from the ensuing disclosure. The base plate can be secured to the work surface as by fasteners or the like.

Figure 5:
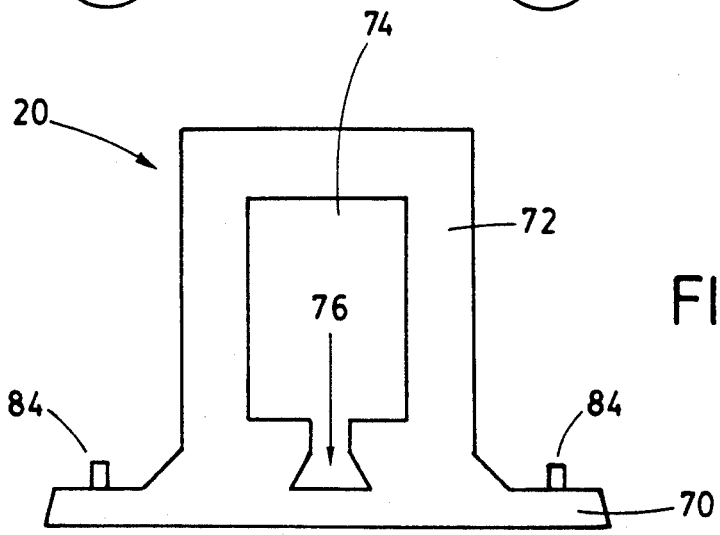
FIG. 5 is an elevational view of a body element of the vise mechanism.
Figure 6:
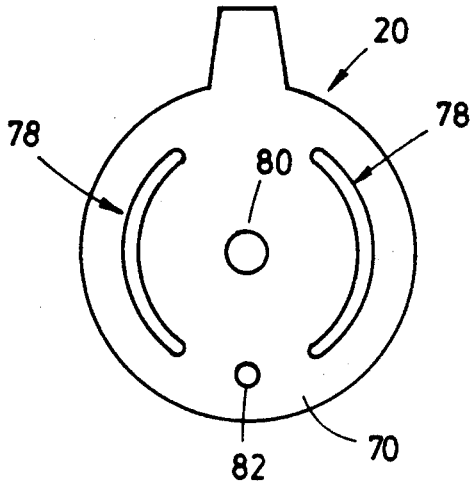
FIG. 6 is a bottom view of the body element shown in FIG. 5.

Referring next to FIGS. 3, 5 and 6, the base 20 includes a circular bottom portion 70 on which is mounted a rectangular body portion 72 having a rectangular slot 74 defined therethrough. A dovetail groove 76 is defined in the bottom to open into the slot 74. Two arcuate slots 78 are defined through the bottom portion 70 and two fastener receiving bores 80 and 82 are defined through the bottom portion near the center thereof and the periphery thereof respectively. A fastener 84 is mounted on each side of the body portion 72 and extends through one of the arcuate slots 78 and through one of the fastener receiving bores 68 to attach the body 20 to the base 66. The fasteners are releasably attached to the base so the body can be rotated with respect to that base. A fastener 86 is shown in FIG. 7, and fits through fastener receiving hole 82.

Referring next to FIGS. 8, 9, 10 and 11, it is seen that the body 20 further includes a mounting element 90 having a dovetail like base 92 mounted in the dovetail groove 76. An internally threaded bore 94 extends through the element 90 in a direction that will extend along the groove 76 when the element 90 is mounted in that groove 76, and a second internally threaded bore 96 that extends upwardly toward the first bore 94. The fastener element 86 is received through fastener receiving bore 82 and threadably cooperates with the internally threaded bore 96 to affix the mounting element 90 to the body 20 with the dovetail elements 92 received in the dovetail groove 76. A fastener 98 fits through bores 70 and 80 that are aligned when the body 20 is in place on the base to attach the body to the base. A bushing 100 cooperates with the fastener 98 and the aligned bores 70 and 80 to permit the body to swivel about an axis formed by the fastener 89 with the fasteners 84 extending through the arcuate slots 78 and attached to the base via the bores 68 when loosened. These fasteners 84 can then be tightened down to secure the body to the base in the chosen orientation. When the element 94 is in place on the body 20, the bore 94 is horizontally oriented above the surface of the element 66.

Figure 12:
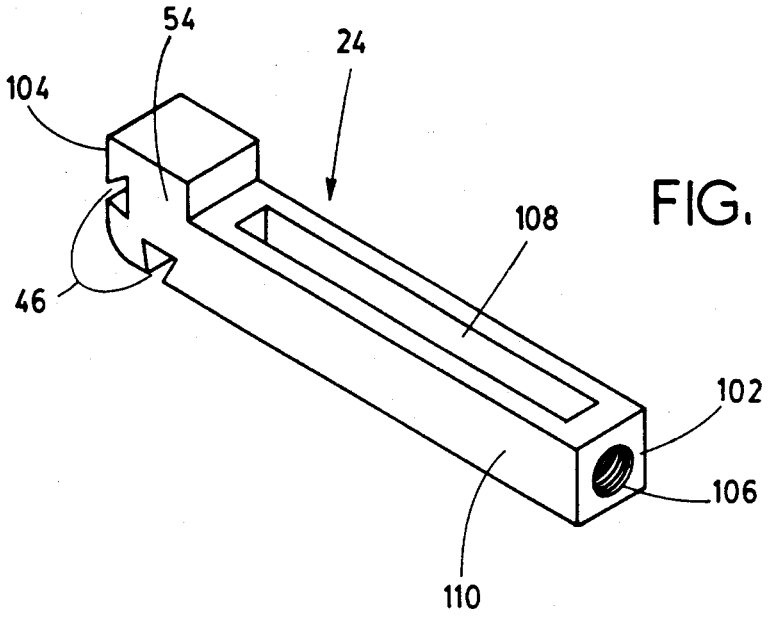
FIG. 12 is a bottom perspective view of a slide element used in the vise mechanism.

Referring next to FIG. 12, it is seen that the slide element 24 includes a first end 102 and a second end 104, with an internally threaded bore 106 being defined through the first end and an elongated slot 108 defined in the body 110 thereof. The slot 108 is sized and located to slidably receive mounting element 90 so the slide element can slide with respect to that mounting element as indicated in FIG. 1 by arrow 25. The purpose of the threaded bore 106 will be understood from the ensuing discussion.

Figure 13:
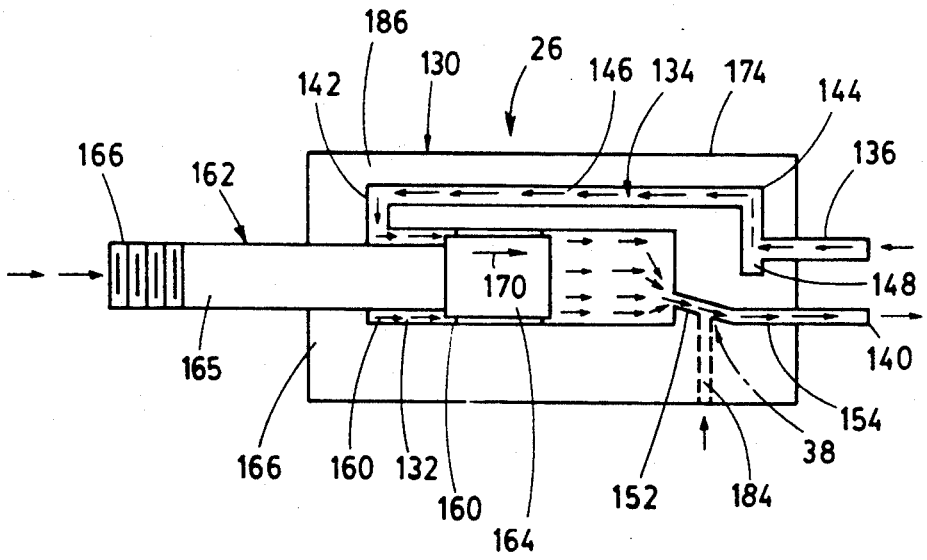
FIG. 13 is a cutaway side elevational view of a hydraulic piston cylinder unit used in the vise mechanism.

As shown in FIGS. 3 and 13, the hydraulic unit 26 is mounted on the body 20 and on the slide element 24. The hydraulic unit moves the slide element with respect to the body 20, and includes a cylinder housing 130 having a chamber 132 defined therein with a U-shaped inlet passage 134 fluidically connecting one end of the chamber 132 to an inlet port 136 and a second chamber 138 fluidically connecting a second end of the chamber to an outlet port 140. The U-shaped inlet passage includes a first short leg 142 and a second short leg 144 connected together by a bight section 146, with one portion 148 of the leg 144 extending past the inlet port 136. The second leg 144 includes a first portion 152 fluidically connecting the chamber 132 to a second portion 154. Fluid, such as hydraulic oil or the like, moves into and through the chamber 132 as indicated by arrows 160 from the inlet port 136 to the outlet port 140.

The hydraulic unit also includes a piston element 162 having a piston head 164 on one end of a piston rod 165 and a threaded connection 166 on the other end of the piston rod. The cylinder housing 132 includes a bore through end 166 through which the piston rod 165 slidably extends and the piston element head 164 is mounted in the chamber 132 to reciprocate in direction 170 with respect to the housing 130 under the influence of the hydraulic fluid flowing through the chamber in direction 160, and in the reverse direction when the fluid flows through the chamber in the reverse direction. As is shown in FIG. 13, the piston head is smaller than the internal dimension of the chamber whereby the fluid flows past the piston as indicated by arrow 160'. However, sufficient area on the piston head is exposed to the hydraulic fluid to move the piston. As is best shown in FIG. 3, the cylinder 130 includes a first external threaded portion 172 on one end thereof and a second external threaded portion 174 on the other end thereof. A cap 176 is threadably connected to the second threaded portion, and the first threaded portion 172 is threadably connected to the threaded bore 106 of the slide element 24.

The threaded connection 166 of the piston rod 162 is connected to the threaded connection 94 of the mounting element 90. Therefore, movement of the piston with respect to the housing under the influence of hydraulic fluid flowing through chamber 132 causes the housing to move thereby causing the slide element 24 to move with respect to the body 20 to which the mounting element 94 is connected. Thus, in effect, the housing 130 moves with respect to the piston rod when fluid flows through the chamber 132. Since the housing is connected to the slide element, this slide element will move with respect to the mounting element 90. Two pressure gauges 180 and 182 are mounted on the housing 130 to indicate the pressure of fluid entering the chamber 132 and exiting that chamber 132. One port 184 is shown in FIG. 13 to which the gauge 182 is connected. A similar port 186 is also indicated in FIG. 13 to which gauge 180 is connected.

Figure 14:
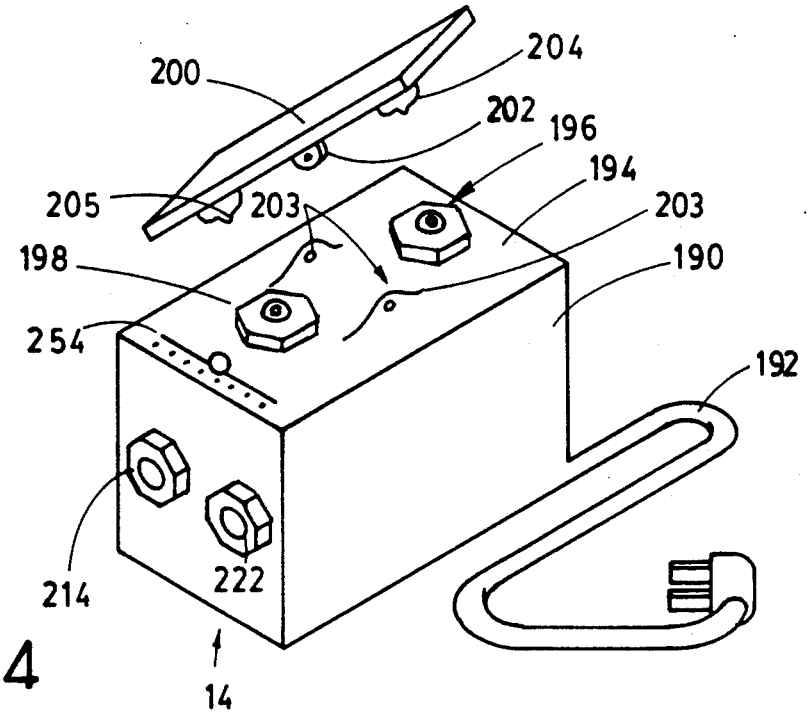
FIG. 14 is a top and end perspective view of a hydraulic system reservoir and pump unit used to operate the piston cylinder unit shown in FIG. 13.

The hydraulic unit 14 is shown in FIG. 14, and includes a housing 190 in which an electrically operated pump is located to be submerged in a reservoir of hydraulic fluid. The pump is the usual submerged type pump and is operated using power from a source (not shown) supplied thereto via a power line 192. The housing includes a top surface 194 on which is mounted an "on" button 196 and an "off" button 198. These buttons are operated by depressing them, and a foot-operated lever 200 is pivotally mounted on the housing top surface by fulcrum connections 202 and 203 to operate such buttons. The lever includes projections 204 and 205 that engage the buttons 196 and 198 respectively to operate the pump.

Figure 15:
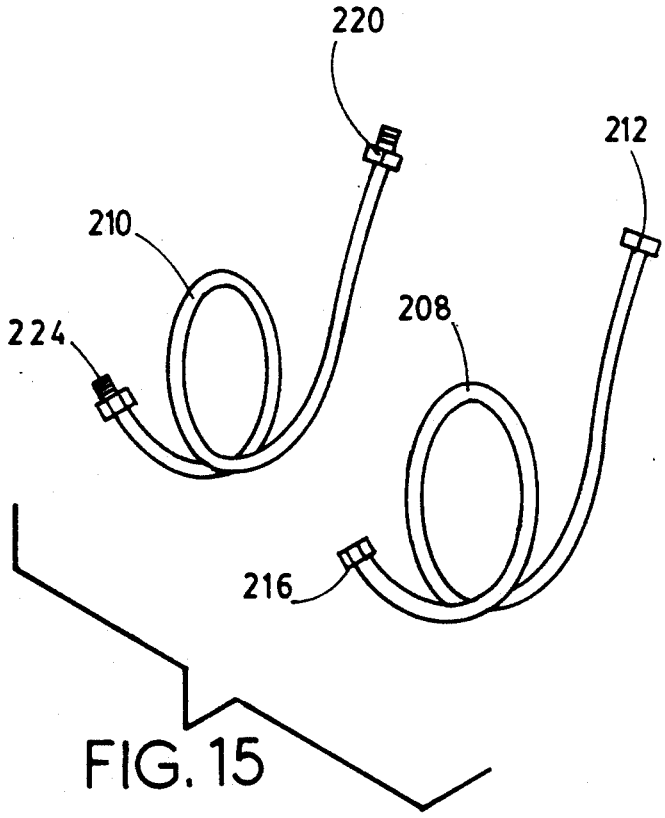
FIG. 15 is a perspective view of two hydraulic fluid lines used to connect FIG. 14 reservoir and pump unit to the FIG. 13 cylinder and piston unit.

Fluid lines 208 and 210, shown in FIG. 15 fluidically connect the pump in the housing 190 to the inlet port 136 and to the outlet port 140 respectively. The fluid line 208 is connected at one end 212 thereof to a port 214 on the housing and at the other end 216 thereof to a connection 218 on the cap 176. The other fluid line 210 is connected at one end 220 thereof to a port 222 on the housing and at another end 224 thereof to a connection 226 on the cap 176. The connections 218 and 226 are fluidically connected to the ports 136 and 140 respectively to transfer fluid between the pump in the housing 190 and the chamber 132 in the manner discussed above to move the housing 130 with respect to piston 164.

Figure 16:
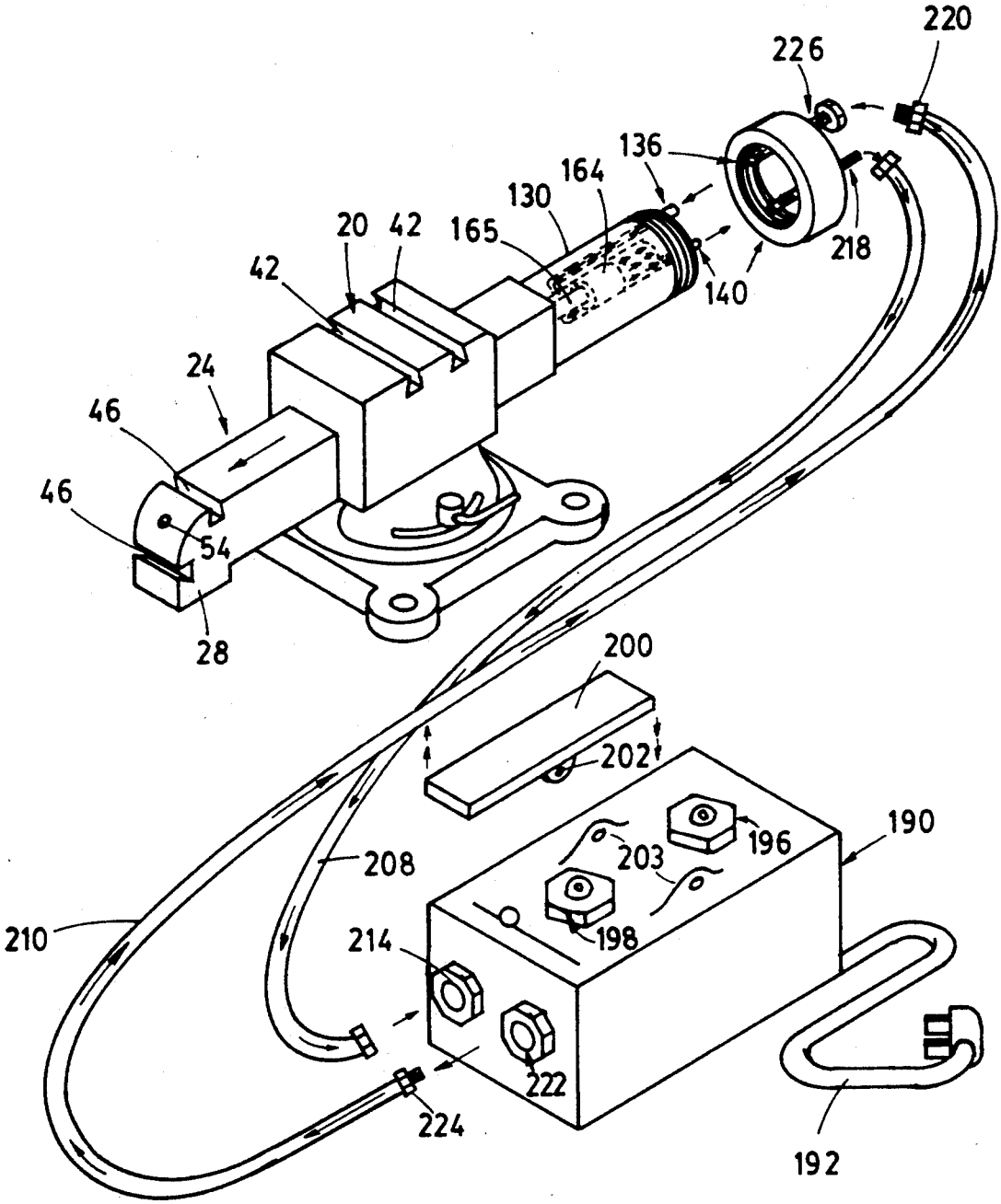
FIG. 16 is a perspective view of the overall vise mechanism in a configuration to open the vise.
Figure 17:
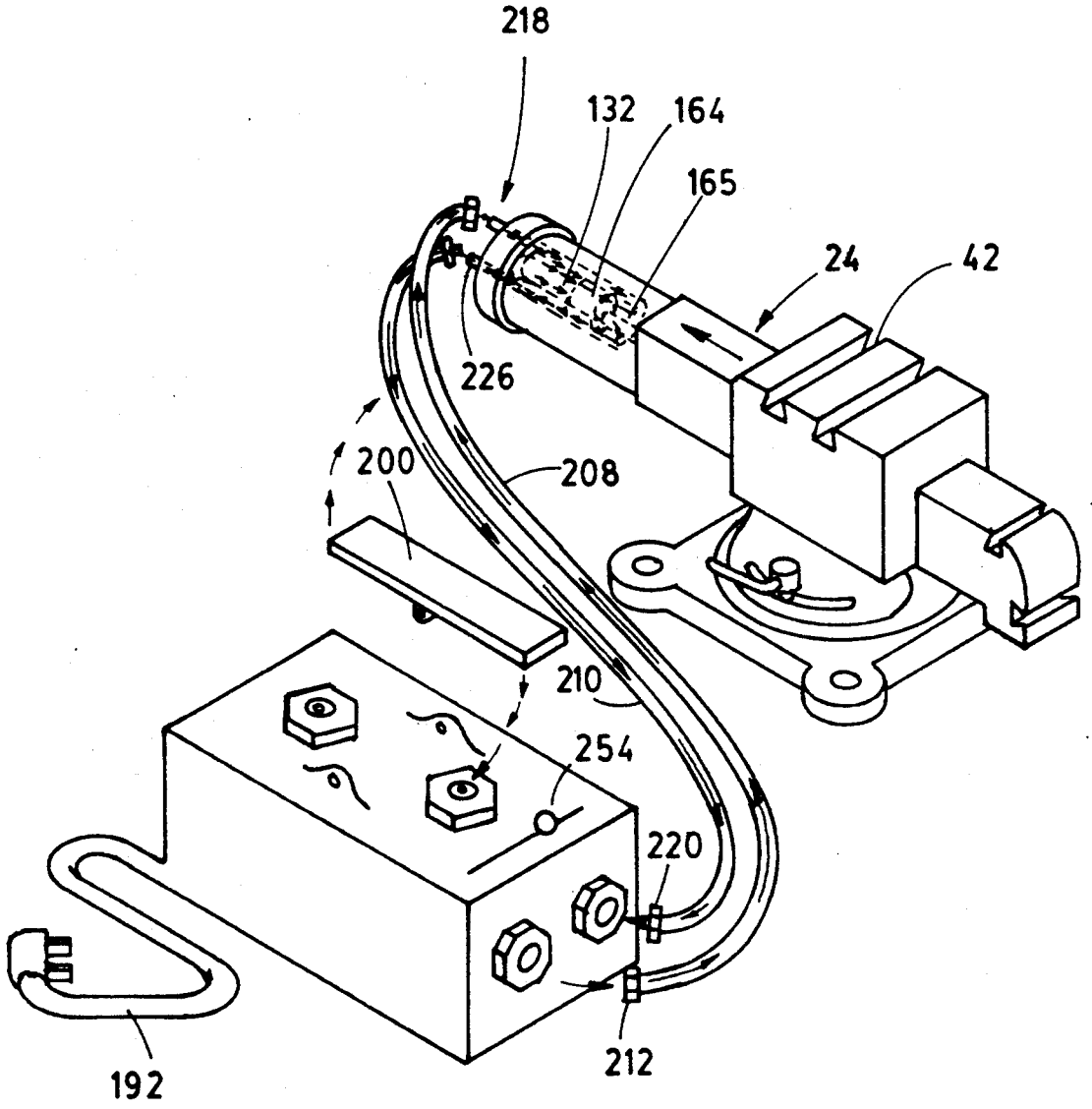
FIG. 17 is a perspective view of the overall vise mechanism in a configuration to close the vise.

Operation of the overall mechanism is indicated in FIGS. 16 (opening of one jaw with respect to the other) and 17 (closing the jaws by moving them towards each other).

The overall unit also includes the spring 32 connected at one end thereof to the cylinder housing 130 and at the other end thereof to the slide unit body 20. A handle 252 is also mounted on the cylinder housing to facilitate manual operation when desired, and a control unit 254 is located on the reservoir housing 190 to control the operation of the pump located inside that reservoir housing.

It is understood that while certain forms of the present invention have been illustrated and described herein, it is not to be limited to the specific forms or arrangements of parts described and shown.

I claim:

1. A hands-free vise mechanism comprising:

A) a base unit which includes
  1) a plurality of legs for mounting said base unit on a support surface,
  2) a base element connected to said legs, and having a central bore defined therethrough and two internally threaded end bores defined therethrough;

B) a body unit mounted on said base unit and which includes
  1) a bottom portion having a dovetail shaped groove defined therein, a central bore defined therethrough into said groove, a rectangular slot defined therethrough adjacent to said groove, two fasteners attached to said bottom portion and to said base element end bores, an end bore near one end of said groove, and two arcuate slots extending through said bottom portion,
  2) a mounting element fixed to said bottom portion in said bottom portion groove and including a dovetail shaped bottom that is received in said bottom portion groove, a first threaded bore in a bottom surface of said mounting element, and a second threaded bore defined through said mounting element to extend along said bottom portion groove when said mounting element is fixed to said bottom element, and
  3) a fastener element extending through said bottom portion end bore and threadably attached to said mounting element first threaded bore;

C) a threaded fastener unit which includes a threaded element extending through said base central bore and through said body unit central bore and including a bushing located adjacent to said body bottom portion groove and to which said threaded element is threadably attached;

D) two releasable threaded fastener elements each extending through one of said bottom portion arcuate slots and attached to one of said base unit threaded end bores;

E) a slide element slidably mounted on said body unit and including
  1) a rectangular body having a first end and a second end and an elongated slot defined therein and extending between said rectangular body ends and being slidably mounted in said rectangular slot,
  2) dovetail mounting grooves on one end of said rectangular body,
  3) an internally threaded bore defined through said slide element rectangular body second end,
  4) said elongated slot slidably receiving said mounting element;

F) a hydraulic unit connected to said slide element for moving said slide element with respect to said body and including
  1) a cylinder housing having a first externally threaded portion on one end thereof and a second externally threaded portion on a second end thereof, said first externally threaded portions being connected to said slide element internally threaded bore, and a cap element threadably connected to said second externally threaded portion,
  2) said housing having a fluid inlet port on said second end and a fluid outlet port on said second end,
  3) a fluid chamber located inside of said housing and including a U-shaped passage having two short legs connected together by a bight section, with one of said short legs being fluidically connected to said inlet port,
  4) a central fluid chamber connected at one end thereof to a second short leg said U-shaped passage two short legs and having a second end,
  5) an outlet passage connected at one end thereof to said central fluid chamber second end and having another end fluidically connected to said outlet port,
  6) a piston element slidably mounted on said housing and including a piston head slidably located in said central chamber, a piston rod connected at one end thereof to said piston head and having a second end with an external threaded portion thereon, said piston rod second end external threaded portion being threadably connected to said mounting element second threaded bore, 7) a first pressure gauge fluidically connected to said second short leg, 8) a second pressure gauge fluidically connected to said passage; and G) a hydraulic reservoir and pump unit including 1) an "on" switch connected to a pump, 2) an "off" switch connected to said pump, 3) a pump speed control system connected to said pump, 4) a lever mounted on said reservoir and pump unit and having one end thereof adjacent to said "on" switch and another end thereof adjacent to said "off" switch and a fulcrum located between said lever ends, 5) a power cord connected to the pump of said reservoir and pump unit for connecting said pump unit to a power source, 6) a fluid outlet port, 7) a fluid inlet port, 8) a first fluid line connecting said reservoir and pump unit port to said hydraulic unit inlet port, and 9) a second fluid line connecting said reservoir and pump unit inlet port to said hydraulic unit outlet port.

2. The hands-free vise mechanism defined in claim 1 wherein one of said fluid lines has an externally threaded coupling on each end thereof.

3. The hands-free vise mechanism defined in claim 2 wherein the other one of said fluid lines has an internally threaded coupling on each end thereof.

4. The hands-free vise mechanism defined in claim 3 wherein said body unit further includes a jaw mounting means thereon.

5. The hands-free vise mechanism defined in claim 4 wherein said body unit jaw mounting means includes two dovetail shaped mounting grooves.

6. The hands-free vise mechanism defined in claim 5 further including a spring connected at one end thereof to said cylinder housing and at another end thereof to said body unit.

7. The hands-free vise mechanism defined in claim 6 further including a handle mounted on said cylinder housing.

8. The hands-free vise mechanism defined in claim 7 wherein said piston head is smaller than said central chamber and bypass areas are defined between said piston head and said housing adjacent to said central chamber.

9. The hands-free vise mechanism defined in claim 8 a clamping element mounted in said jaw mounting means.

10. The hands-free vise mechanism defined in claim 9 wherein said clamping element includes a clam-shell clamping plate.

* * * * *